US008480816B2

(12) United States Patent
Ozeki et al.

(10) Patent No.: US 8,480,816 B2
(45) **Date of Patent: *Jul. 9, 2013**

(54) PERMANENT MAGNET AND MANUFACTURING METHOD THEREOF

(75) Inventors: Izumi Ozeki, Ibaraki (JP); Katsuya Kume, Ibaraki (JP); Keisuke Hirano, Ibaraki (JP); Tomohiro Omure, Ibaraki (JP); Keisuke Taihaku, Ibaraki (JP); Takashi Ozaki, Ibaraki (JP)

(73) Assignee: Nitto Denko Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/499,434

(22) PCT Filed: Mar. 28, 2011

(86) PCT No.: PCT/JP2011/057575

§ 371 (c)(1),
(2), (4) Date: Mar. 30, 2012

(87) PCT Pub. No.: WO2011/125594

PCT Pub. Date: Oct. 13, 2011

(65) Prior Publication Data

US 2012/0182105 A1 Jul. 19, 2012

(30) Foreign Application Priority Data

Mar. 31, 2010 (JP) ..... 2010-084156

(51) Int. Cl.
*H01F 1/057* (2006.01)

(52) U.S. Cl.
USPC ..... 148/101; 75/244; 419/12

(58) Field of Classification Search
USPC ..... 148/101, 302; 419/12; 75/244
See application file for complete search history.

(56) References Cited

U.S. PATENT DOCUMENTS

| | | | | |
|---|---|---|---|---|
| 7,244,318 | B2 * | 7/2007 | Sekino et al. | 148/101 |
| 2003/0019326 | A1 | 1/2003 | Han et al. | |
| 2004/0187963 | A1 | 9/2004 | Tayu et al. | |
| 2005/0133117 | A1 * | 6/2005 | Tayu et al. | 148/105 |
| 2006/0231165 | A1 * | 10/2006 | Kato et al. | 148/302 |

(Continued)

FOREIGN PATENT DOCUMENTS

| | | | |
|---|---|---|---|
| EP | 2 267 733 | A1 * | 12/2010 |
| JP | 2001-20065 | A | 1/2001 |
| JP | 3298219 | B2 | 4/2002 |
| JP | 2004-319955 | | 11/2004 |
| JP | 2005-39089 | A | 2/2005 |

(Continued)

OTHER PUBLICATIONS

Supplementary European Search Report issued in Application No. 11765494.7 dated Nov. 7, 2012.

*Primary Examiner* — Roy King
*Assistant Examiner* — Timothy Haug
(74) *Attorney, Agent, or Firm* — Sughrue Mion, PLLC

(57) ABSTRACT

There are provided a permanent magnet and a manufacturing method thereof capable of preventing degrade in the magnetic properties by densely sintering the entirety of the magnet. To fine powder of milled neodymium magnet is added an organometallic compound solution containing an organometallic compound expressed with a structural formula of M-$(OR)_X$ (M represents Dy or Tb, R represents a substituent group consisting of a straight-chain or branched-chain hydrocarbon, $_X$ represents an arbitrary integer) so as to uniformly adhere the organometallic compound to particle surfaces of the neodymium magnet powder. Thereafter, the desiccated magnet powder is calcined by utilizing plasma heating and the powdery calcined body is sintered so as to form a permanent magnet 1.

8 Claims, 7 Drawing Sheets

U.S. PATENT DOCUMENTS

| | | | | |
|---|---|---|---|---|
| 2011/0012700 | A1* | 1/2011 | Ozeki et al. | 335/302 |
| 2011/0043311 | A1* | 2/2011 | Ozeki et al. | 335/302 |
| 2012/0181475 | A1* | 7/2012 | Ozeki et al. | 252/62.51 R |
| 2012/0181476 | A1* | 7/2012 | Ozeki et al. | 252/62.51 R |
| 2012/0187326 | A1* | 7/2012 | Ozeki et al. | 252/62.51 R |
| 2012/0187329 | A1* | 7/2012 | Ozeki et al. | 252/62.51 R |
| 2012/0187612 | A1* | 7/2012 | Ozeki et al. | 264/612 |

FOREIGN PATENT DOCUMENTS

| | | | |
|---|---|---|---|
| JP | 2005-97697 | A | 4/2005 |
| JP | 2005-191187 | A | 7/2005 |
| JP | 2005-197299 | A | 7/2005 |
| JP | 2267733 | A1 * | 12/2010 |
| WO | 2009/116532 | A1 | 9/2009 |

* cited by examiner

FIG. 9

| [Dy] SPECTRUM WAVEFORM ANALYSIS RESULT [area%] | | |
|---|---|---|
| | Dy | $Dy_2O$ or DyO or $Dy_2O_3$ |
| EMBODIMENT | 75 | 25 |
| COMPARATIVE EXAMPLE | 0 | 100 |

PERMANENT MAGNET AND MANUFACTURING METHOD THEREOF

CROSS REFERENCE TO RELATED APPLICATIONS

This application is a National Stage of International Application No. PCT/JP2011/057575 filed Mar. 28, 2011, claiming priority based on Japanese Patent Application No. 2010-084156 filed Mar. 31, 2010, the contents of all of which are incorporated herein by reference in their entirety.

TECHNICAL FIELD

The present invention relates to a permanent magnet and manufacturing method thereof.

BACKGROUND ART

In recent years, a decrease in size and weight, an increase in power output and an increase in efficiency have been required in a permanent magnet motor used in a hybrid car, a hard disk drive, or the like. To realize such a decrease in size and weight, an increase in power output and an increase in efficiency in the permanent magnet motor mentioned above, a further improvement in magnetic performance is required of a permanent magnet to be buried in the permanent magnet motor. Meanwhile, as permanent magnet, there have been known ferrite magnets, Sm—Co-based magnets, Nd—Fe—B-based magnets, $Sm_2Fe_{17}N_x$-based magnets or the like. As permanent magnet for permanent magnet motor, there are typically used Nd—Fe—B-based magnets among them due to remarkably high residual magnetic flux density.

As method for manufacturing a permanent magnet, a powder sintering process is generally used. In this powder sintering process, raw material is coarsely milled first and furthermore, is finely milled into magnet powder by a jet mill (dry-milling) method. Thereafter, the magnet powder is put in a mold and pressed to form in a desired shape with magnetic field applied from outside. Then, the magnet powder formed and solidified in the desired shape is sintered at a predetermined temperature (for instance, at a temperature between 800 and 1150 degrees Celsius for the case of Nd—Fe—B-based magnet) for completion.

PRIOR ART DOCUMENT

Patent Document

Patent document 1: Japanese Registered Patent Publication No. 3298219 (pages 4 and 5)

DISCLOSURE OF THE INVENTION

Problem to be Solved by the Invention

On the other hand, as to Nd-based magnets such as Nd—Fe—B magnets, poor heat resistance is pointed to as defect. Therefore, in case a Nd-based magnet is employed in a permanent magnet motor, continuous driving of the motor brings the magnet into gradual decline of residual magnetic flux density and irreversible demagnetization. Then, in case of employing a Nd-based magnet in a permanent magnet motor, in order to improve heat resistance of Nd-based magnet, Dy (dysprosium) or Tb (terbium) having high magnetic anisotropy is added in attempt to further improve coercive force.

As method for adding Dy or Tb, there have been conventionally known two methods: a grain boundary diffusion method such that Dy or Tb is made to be put on a surface of a sintered magnet so as to be diffused; and a two-alloys method such that two types of powder corresponding to a main phase and a grain boundary phase are separately made and thereafter mixed (dry blending). Those methods have their own defects. The former method is effective for magnets in flat shape or in fragments, but in a form of a large-sized magnet, a diffusion length of Dy or Tb cannot be extended to a grain boundary phase formed inside. In the latter method, magnets are made by blending and pressing the two alloys, which results in diffusion of Dy or Tb in grains and failure to get Dy or Tb concentrated in a grain boundary.

Further, Dy or Tb is rare metal and producing regions are limited. It is therefore preferable to curtail even small amount of Dy or Tb to be used with respect to that of Nd. Furthermore, as problem, addition of large amount of Dy or Tb lowers residual magnetic flux density which represents magnet intensity. Thus, there has been desired art to efficiently concentrate traces of Dy or Tb in a grain boundary so as to significantly improve coercive force of a magnet without decline of residual magnetic flux density.

Further, it would be practicable to add Dy or Tb in a state of being distributed in an organic solvent, to a Nd-based magnet so as to concentrate Dy or Tb in a grain boundary of the magnet. Generally speaking, however, Dy or Tb is present in a state being bound with oxygen contained in the organic solvent. Here, as Nd has high reactivity with oxygen, the presence of oxygen causes Nd to bind with the oxygen to form a Nd oxide at a sintering process. As a result, there occurs a problem of decrease of magnetic properties. Furthermore, binding of Nd with oxygen makes the Nd content deficient compared with the content based on the stoichiometric composition ($Nd_2Fe_{14}B$). Consequently, alpha iron separates out in the main phase of the sintered magnet, which causes a problem of serious degrade in the magnetic properties.

The present invention has been made to resolve the above described conventional problem and the object thereof is to provide a permanent magnet and manufacturing method thereof capable of: efficiently concentrating traces of Dy or Tb contained in an organometallic compound on a grain boundary of the magnet; previously reducing oxygen content contained in magnet particles by calcining the organometallic-compound-added magnet powder before sintering, specifically, calcination by plasma heating; and preventing degrade in the magnetic properties.

Means for Solving the Problem

To achieve the above object, the present invention provides a permanent magnet manufactured through steps of: milling magnet material into magnet powder; adding an organometallic compound expressed with a structural formula of $M\text{-}(OR)_X$ (M representing Dy or Tb, R representing a substituent group consisting of a straight-chain or branched-chain hydrocarbon, and $_X$ representing an arbitrary integer) to the magnet powder obtained at the step of milling magnet material and getting the organometallic compound adhered to particle surfaces of the magnet powder; calcining the magnet powder of which particle surfaces have got adhesion of the organometallic compound by plasma heating so as to obtain a calcined body; compacting the calcined body so as to obtain a compact body; and sintering the compact body.

To achieve the above object, the present invention provides a permanent magnet manufactured through steps of: milling magnet material into magnet powder; adding an organometallic compound expressed with a structural formula of M-$(OR)_X$ (M representing Dy or Tb, R representing a substituent group consisting of a straight-chain or branched-chain hydrocarbon, and $_X$ representing an arbitrary integer) to the magnet powder obtained at the step of milling magnet material and getting the organometallic compound adhered to particle surfaces of the magnet powder; compacting the magnet powder of which particle surfaces have got adhesion of the organometallic compound so as to obtain a compact body; calcining the compact body by plasma heating so as to obtain a calcined body; and sintering the calcined body.

In the above-described permanent magnet of the present invention, the calcined body is obtained at the step of calcining by high temperature hydrogen plasma heating.

In the above-described permanent magnet of the present invention, R in the structural formula is an alkyl group.

In the above-described permanent magnet of the present invention, R in the structural formula is an alkyl group of which carbon number is any one of integer numbers 2 through 6.

In the above-described permanent magnet of the present invention, metal contained in the organometallic compound is concentrated in a grain boundary of the permanent magnet after sintering.

In the above-described permanent magnet of the present invention, metal contained in the organometallic compound forms a layer on crystal grain surfaces of the permanent magnet after the sintering, the layer having thickness ranging from 1 nm to 500 nm.

To achieve the above object, the present invention further provides a manufacturing method of a permanent magnet comprising steps of: milling magnet material into magnet powder; adding an organometallic compound expressed with a structural formula of M-$(OR)_X$ (M representing Dy or Tb, R representing a substituent group consisting of a straight-chain or branched-chain hydrocarbon, and $_X$ representing an arbitrary integer) to the magnet powder obtained at the step of milling magnet material and getting the organometallic compound adhered to particle surfaces of the magnet powder; calcining the magnet powder of which particle surfaces have got adhesion of the organometallic compound by plasma heating so as to obtain a calcined body; compacting the calcined body so as to obtain a compact body; and sintering the compact body.

To achieve the above object, the present invention provides a manufacturing method of a permanent magnet comprising steps of: milling magnet material into magnet powder; adding an organometallic compound expressed with a structural formula of M-$(OR)_X$ (M representing Dy or Tb, R representing a substituent group consisting of a straight-chain or branched-chain hydrocarbon, and $_X$ representing an arbitrary integer) to the magnet powder obtained at the step of milling magnet material and getting the organometallic compound adhered to particle surfaces of the magnet powder; compacting the magnet powder of which particle surfaces have got adhesion of the organometallic compound so as to obtain a compact body; calcining the compact body by plasma heating so as to obtain a calcined body; and sintering the calcined body.

In the above-described manufacturing method of a permanent magnet of the present invention, the calcined body is obtained at the step of calcining by high temperature hydrogen plasma heating.

In the above-described manufacturing method of a permanent magnet of the present invention, R in the structural formula is an alkyl group.

In the above-described manufacturing method of a permanent magnet of the present invention, R in the structural formula is an alkyl group of which carbon number is any one of integer numbers 2 through 6.

Effect of the Invention

According to the permanent magnet of the present invention, traces of Dy or Tb contained in the organometallic compound that has been added to the magnet can be efficiently concentrated in a grain boundary of the magnet. Furthermore, since the organometallic-compound-added magnet powder is calcined by plasma heating prior to sintering, oxygen content contained in magnet particles can be reduced before sintering of the magnet. Consequently, since such mannered manufacturing process can prevent alpha iron from separating out in a main phase of the sintered magnet and also prevent formation of oxides, serious degrade in the magnetic properties can be avoided.

Furthermore, the calcination process is performed to the powdered magnet particles, which is advantageous in that the reduction of metal oxides can be performed more easily to the whole magnet particles, compared with a case where the magnet particles are calcined after compaction. That is, the oxygen content in the powdered magnet particles can be more reliably decreased.

According to the permanent magnet of the present invention, traces of Dy or Tb contained in the organometallic compound that has been added to the magnet can be efficiently concentrated in a grain boundary of the magnet. Furthermore, since the compact body consisting of the organometallic-compound-added magnet powder is calcined by plasma heating prior to sintering, oxygen content contained in magnet particles can be reduced before sintering of the magnet. Consequently, since such mannered manufacturing process can prevent alpha iron from separating out in a main phase of the sintered magnet and also prevent formation of oxides, serious degrade in the magnetic properties can be avoided.

According to the permanent magnet of the present invention, since the high temperature hydrogen plasma heating is applied as specific means for calcination, high concentration of hydrogen radicals can be generated. Accordingly, even if the metal forming an organometallic compound is present in the magnet powder in a state of a stable oxide, the reduction to a metal or lowering of the oxidation number thereof can be easily performed at a low temperature using the hydrogen radicals.

According to the permanent magnet of the present invention, the organometallic compound composed of alkyl group is used as organometallic compound to be added to the magnet powder. Therefore, thermal decomposition of the organometallic compound can be caused easily. Consequently, in a case where magnet powder or a compact body is calcined in hydrogen prior to sintering, for instance, carbon content in the magnet powder or the compact body can be reduced more reliably. Accordingly, such mannered manufacturing process can prevent alpha iron from separating out within a main phase of the sintered magnet. Thereby, the whole magnet can be densely sintered and the lowering of the coercive force can be prevented.

According to the permanent magnet of the present invention, the organometallic compound composed of alkyl group of carbon number 2-6 is used as organometallic compound to be added to the magnet powder. Therefore, thermal decomposition of the organometallic compound can be caused at a low temperature. Consequently, in a case where magnet powder or a compact body is calcined in hydrogen prior to sintering, for instance, thermal decomposition of the organometallic compound can be easily caused to the whole magnet powder or the whole compact body. That is, through the calcination process, carbon content contained in the magnet powder or the compact body can be reduced more reliably.

According to the permanent magnet of the present invention, Dy or Tb having high magnetic anisotropy gets concentrated in a grain boundary of the sintered magnet. Therefore, coercive force can be improved by Dy or Tb, concentrated at the grain boundary, preventing a reverse magnetic domain from being generated in the grain boundary. Further, since amount of Dy or Tb added thereto is less in comparison with conventional amount thereof, decline in residual magnetic flux density can be avoided.

According to the permanent magnet of the present invention, Dy or Tb having high magnetic anisotropy forms a layer of 1 nm-500 nm on the surface of each magnet particle after sintering. Thereby, coercive force can be improved by Dy or Tb while decline in residual magnetic flux density is avoided.

According to the manufacturing method of a permanent magnet of the present invention, it is made possible to manufacture a permanent magnet configured such that traces of Dy or Tb contained in the organometallic compound that has been added to the magnet can be efficiently concentrated in a grain boundary of the magnet. Furthermore, since the organometallic-compound-added magnet powder is calcined by plasma heating prior to sintering, oxygen content contained in magnet particles can be reduced before sintering of the magnet. Consequently, since such mannered manufacturing process can prevent alpha iron from separating out in a main phase of the sintered magnet and also prevent formation of oxides, serious degrade in the magnetic properties can be avoided.

Furthermore, the calcination process is performed to the powdered magnet particles, which is advantageous in that the reduction of metal oxides can be performed more easily to the whole magnet particles, compared with a case where the magnet particles are calcined after compaction. That is, the oxygen content in the powdered magnet particles can be more reliably decreased.

According to the manufacturing method of a permanent magnet of the present invention, it is made possible to manufacture a permanent magnet configured such that traces of Dy or Tb contained in the organometallic compound that has been added to the magnet can be efficiently concentrated in a grain boundary of the magnet. Furthermore, since the compact body consisting of the organometallic-compound-added magnet powder is calcined by plasma heating prior to sintering, oxygen content contained in magnet particles can be reduced before sintering of the magnet. Consequently, since such mannered manufacturing process can prevent alpha iron from separating out in a main phase of the sintered magnet and also prevent formation of oxides, serious degrade in the magnetic properties can be avoided.

According to the manufacturing method of a permanent magnet of the present invention, since the high temperature hydrogen plasma heating is applied as specific means for calcination, high concentration of hydrogen radicals can be generated. Accordingly, even if the metal forming an organometallic compound is present in the magnet powder in a state of a stable oxide, the reduction to a metal or lowering of the oxidation number thereof can be easily performed at a low temperature using the hydrogen radicals.

According to the manufacturing method of a permanent magnet of the present invention, the organometallic compound composed of alkyl group is used as organometallic compound to be added to the magnet powder. Therefore, thermal decomposition of the organometallic compound can be caused easily. Consequently, in a case where magnet powder or a compact body is calcined in hydrogen prior to sintering, for instance, carbon content in the magnet powder or the compact body can be reduced more reliably. Accordingly, such mannered manufacturing process can prevent alpha iron from separating out within the main phase of the sintered magnet. Thereby, the whole magnet can be densely sintered and the lowering of the coercive force can be prevented.

According to the manufacturing method of a permanent magnet of the present invention, the organometallic compound composed of alkyl group of carbon number 2-6 is used as organometallic compound to be added to the magnet powder. Therefore, thermal decomposition of the organometallic compound can be caused at a low temperature. Consequently, in a case where magnet powder or a compact body is calcined in hydrogen prior to sintering, for instance, thermal decomposition of the organometallic compound can be easily caused to the whole magnet powder or the whole compact body. That is, through the calcination process, carbon content contained in the magnet powder or the compact body can be reduced more reliably.

BRIEF DESCRIPTION OF THE DRAWINGS

FIG. 9 is a chart depicting a result on waveform analysis of the spectra of FIG. 8.

BEST MODE FOR CARRYING OUT THE INVENTION

Specific embodiments of a permanent magnet and a method for manufacturing the permanent magnet according to the present invention will be described below in detail with reference to the drawings.

[Constitution of Permanent Magnet]

Figure 1:
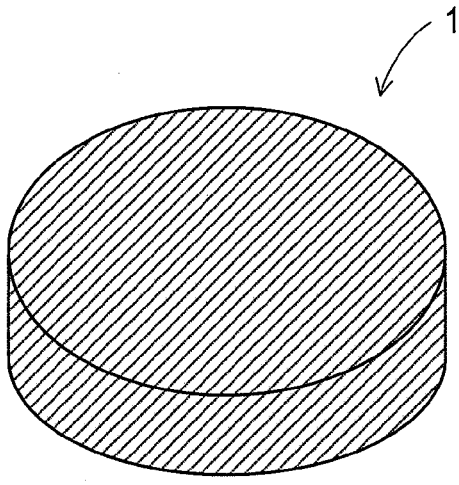
FIG. 1 is an overall view of a permanent magnet directed to the invention.

First, a constitution of a permanent magnet 1 will be described. FIG. 1 is an overall view of the permanent magnet directed to the present invention. Incidentally, the permanent magnet 1 depicted in FIG. 1 is formed into a cylindrical shape. However, the shape of the permanent magnet 1 may be changed in accordance with the shape of a cavity used for compaction.

As the permanent magnet 1 according to the present invention, an Nd—Fe—B-based magnet may be used, for example. Further, Dy (dysprosium) or Tb (terbium) for increasing the coercive force of the permanent magnet 1 is concentrated on the boundary faces (grain boundaries) of Nd crystal grains forming the permanent magnet 1. Incidentally, the contents of respective components are regarded as Nd: 25 to 37 wt %, Dy (or Tb): 0.01 to 5 wt %, B: 1 to 2 wt %, and Fe (electrolytic iron): 60 to 75 wt %. Furthermore, the permanent magnet 1 may include other elements such as Co, Cu, Al or Si in small amount, in order to improve the magnetic properties thereof.

Figure 2:
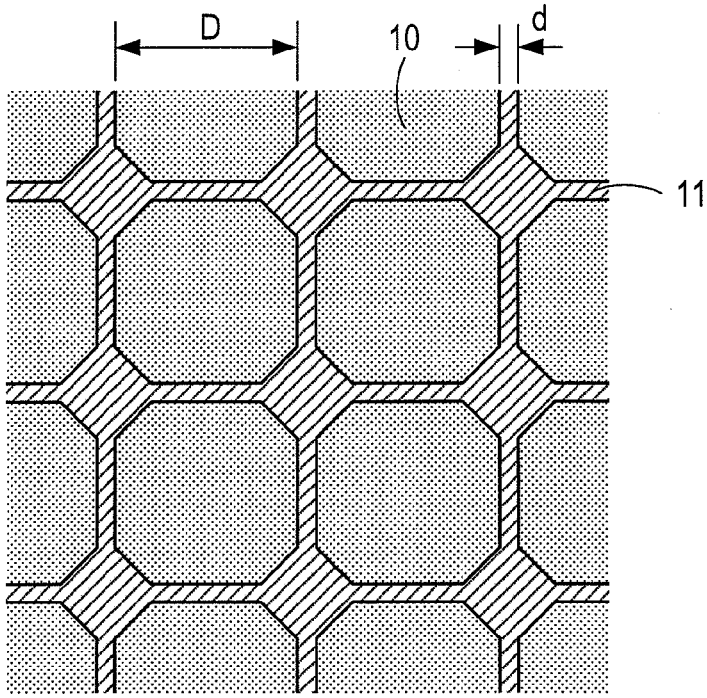
FIG. 2 is an enlarged schematic view in vicinity of a grain boundary of the permanent magnet directed to the invention.

Specifically, in the permanent magnet 1 according to the present invention, Dy (or Tb) is concentrated onto the grain boundaries of the Nd crystal grains 10 by coating each surface of the Nd crystal grains 10 constituting the permanent magnet 1 with a Dy layer (or Tb layer) 11 as depicted in FIG. 2. FIG. 2 is an enlarged view showing the Nd crystal grains 10 constituting the permanent magnet 1.

The permanent magnet 1, as shown in FIG. 2, is constituted of the Nd crystal grains 10 and the Dy layers (or Tb layers) 11 coating the surfaces of Nd crystal grains 10. The Nd crystal grains 10 are, for instance, composed of an $Nd_2Fe_{14}B$ intermetallic compound, and the Dy layers 11 are, for instance, composed of a $(Dy_xNd_{1-x})_2Fe_{14}B$ intermetallic compound.

Figure 3:
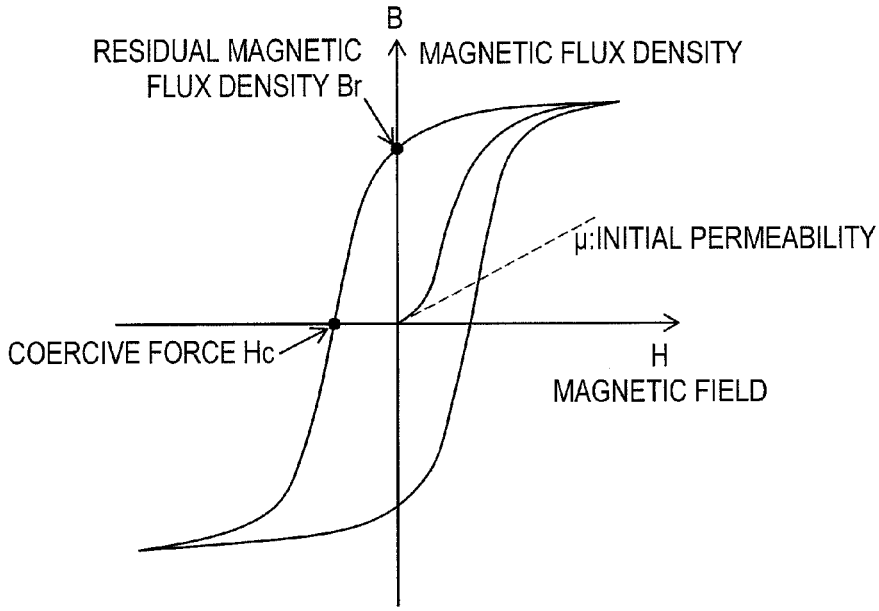
FIG. 3 is a hysteresis curve of a ferromagnetic body.
Figure 4:
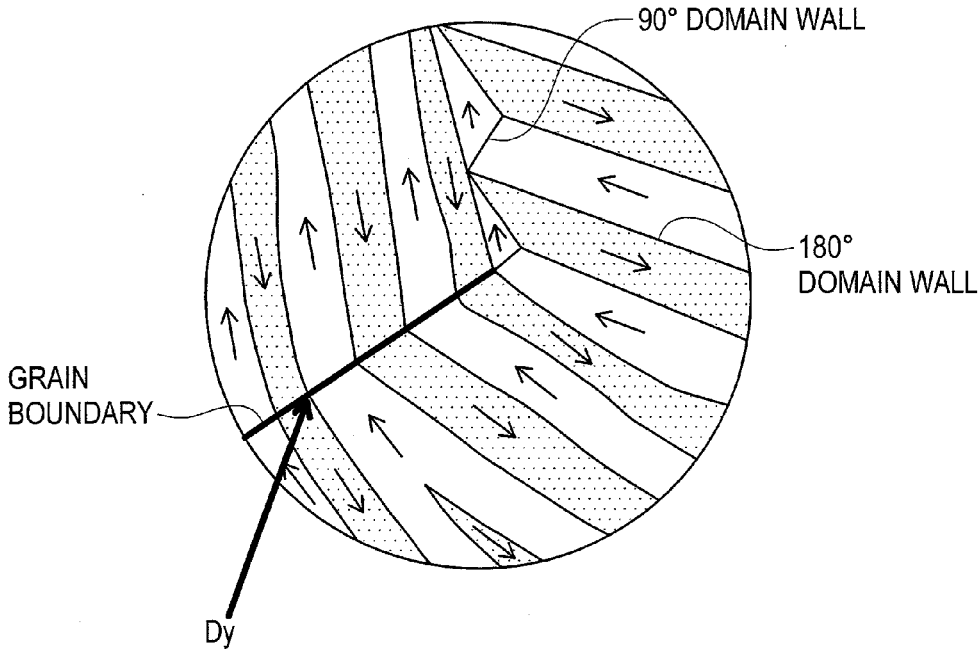
FIG. 4 is a pattern diagram illustrating a magnetic domain structure of the ferromagnetic body.

A mechanism of improving the coercive force of the permanent magnet 1 with the Dy layers (or Tb layers) 11 will be described below referring to FIG. 3 and FIG. 4. FIG. 3 is a hysteresis curve of a ferromagnetic body, and FIG. 4 is a pattern diagram illustrating a magnetic domain structure of the ferromagnetic body.

As shown in FIG. 3, the coercive force of the permanent magnet is the intensity of a magnetic field needed for bringing the magnetic polarization into zero (that is to say, for magnetization reversal) when the magnetic field is applied from a magnetized state in the opposite direction. Accordingly, if the magnetization reversal can be inhibited, high coercive force can be obtained. Incidentally, magnetization processes of a magnetic body include rotational magnetization based on rotation of magnetic moment and domain wall displacement in which domain walls (consisting of a 90-degree domain wall and a 180-degree domain wall) as boundaries of magnetic domains move. In a sintered magnet such as the Nd—Fe—B-based magnet related to the present invention, reverse magnetic domain is most likely to occur in the vicinity of the surface of the crystal grain composing a main phase. Accordingly, in the present invention, through forming a phase where Dy or Tb substitutes for a part of Nd at the surface (outer shell) of a Nd crystal grain 10, the reverse magnetic domain is inhibited from generating. Here, Dy and Tb, with their high magnetic anisotropy, are both useful elements regarding the effect of improving the coercive force of the $Nd_2Fe_{14}B$ intermetallic compound (i.e., inhibiting magnetization reversal).

Here, in the present invention, the substitution of Dy or Tb is carried out before compaction of magnet powder through addition of an organometallic compound containing Dy (or Tb) milled as later described. Specifically, here, the organometallic compound containing the Dy (or Tb) is uniformly adhered to the particle surfaces of the Nd magnet particles by wet dispersion and the Dy (or Tb) included in the organometallic compound diffusively intrudes into the crystal growth region of the Nd magnet particles and substitutes for Nd, to form the Dy layers (or Tb layers) 11 shown in FIG. 2, when the magnet powder to which the organometallic compound containing Dy (or Tb) is added is sintered. As a result, Dy (or Tb) is concentrated in a boundary face of the Nd crystal grains 10 as shown in FIG. 4, thereby enabling the coercive force of the permanent magnet 1 to be improved.

Furthermore, in the present invention, specifically as later described, the organometallic compound containing Dy (or Tb) is expressed by $M\text{-}(OR)_x$ (in the formula, M represents Dy or Tb, R represents a substituent group consisting of a straight-chain or branched-chain hydrocarbon and $_x$ represents an arbitrary integer), and the organometallic compound containing Dy (or Tb) (such as dysprosium ethoxide, dysprosium n-propoxide, terbium ethoxide) is added to an organic solvent and in a wet condition, mixed with the magnet powder. Thus, the organometallic compound containing Dy (or Tb) is dispersed in the organic solvent, enabling the organometallic compound containing Dy (or Tb) to be adhered onto the particle surfaces of Nd magnet particles effectively. Here, metal alkoxide is one of the organometallic compounds that satisfy the above structural formula $M\text{-}(OR)_x$ (in the formula, M represents Dy or Tb, R represents a substituent group consisting of a straight-chain or branched-chain hydrocarbon and $_x$ represents an arbitrary integer). The metal alkoxide is expressed by a general formula $M\text{-}(OR)_n$ (M: metal element, R: organic group, n: valence of metal or metalloid). Furthermore, examples of metal or metalloid composing the metal alkoxide include W, Mo, V, Nb, Ta, Ti, Zr, Ir, Fe, Co, Ni, Cu, Zn, Cd, Al, Ga, In, Ge, Sb, Y, lanthanide and the like. However, in the present invention, Dy or Tb is specifically used.

Furthermore, the types of the alkoxide are not specifically limited, and there may be used, for instance, methoxide, ethoxide, propoxide, isopropoxide, butoxide or alkoxide carbon number of which is 4 or larger. However, in the present invention, those of low-molecule weight are used in order to reduce the carbon residue by means of thermal decomposition at a low temperature to be later described. Furthermore, methoxide carbon number of which is 1 is prone to decompose and difficult to deal with, therefore it is preferable to use alkoxide carbon number of which is 2 through 6 included in R, such as ethoxide, methoxide, isopropoxide, propoxide or butoxide. That is, in the present invention, it is preferable to use, as the organometallic compound to be added to the magnet powder, an organometallic compound expressed by $M\text{-}(OR)_x$ (in the formula, M represents Dy or Tb, R represents a straight-chain or branched-chain alkyl group and $_x$ represents an arbitrary integer) or it is more preferable to use an organometallic compound expressed by $M\text{-}(OR)_x$ (in the formula, M represents Dy or Tb, R represents either of straight-chain or branched-chain alkyl groups carbon number of which are 2 through 6, and $_x$ represents an arbitrary integer).

Furthermore, if Dy or Tb is added to the magnet powder, Dy or Tb is present in a state being bound with oxygen contained in the organometallic compound (such as $Dy_2O$, DyO and $Dy_2O_3$). Here, as Nd has high reactivity with oxygen, the presence of oxygen causes Nd to bind with the oxygen to form a Nd oxide at a sintering process. As a result, there occurs a problem of decrease of magnetic properties. Furthermore, binding of Nd with oxygen makes the Nd content deficient compared with the content based on the stoichiometric composition ($Nd_2Fe_{14}B$). Consequently, alpha iron separates out in the main phase of the sintered magnet, which causes a problem of serious degrade in the magnetic properties. However, Dy or Tb present in the state bound with oxygen can be reduced through calcination process by later-described plasma heating. Thus, the oxygen therein can be lowered. As a result, such mannered manufacturing process can prevent binding of oxygen with Nd at the sintering process and also prevent alpha iron from separating out.

Furthermore, it is desirable to set the grain size D of the Nd crystal grain 10 to be approximately 0.1 μm-5.0 μm. Further, by sintering a compact body compacted through powder compaction under appropriate sintering conditions, Nb or Tb can be prevented from being diffused or penetrated (solid-solutionized) into the Nd crystal grains 10. Thereby the present invention can limit the area to be substituted by Dy or Nd in the outer shell portion only, even if Nd or Tb is added. For example, the thickness d of Dy layer (or Tb layer) 11 is to be set 1 nm-500 nm, or more preferably, 2 nm-200 nm. As a result, the phase of the $Nd_2Fe_{14}B$ intermetallic compound of the core accounts for the large proportion in volume, with respect to crystal grains as a whole (in other words, the sintered magnet in its entirety). Accordingly, the decrease of the residual magnetic flux density (magnetic flux density at the time when the intensity of the external magnetic field is brought to zero) can be inhibited.

Incidentally, the Dy layer (or Tb layer) 11 is not required to be a layer composed of only a Dy compound (or Tb compound), and may be a layer composed of a mixture of a Dy compound (or Tb compound) and a Nd compound. In such a case, a layer composed of the mixture of the Dy compound (or Tb compound) and the Nd compound are formed by adding the Nd compound. As a result, the liquid-phase sintering of the Nd magnet powder can be promoted at the time of sintering. The desirable Nd compound to be added may be $NdH_2$, neodymium acetate hydrate, neodymium(III) acetylacetonate trihydrate, neodymium(III) 2-ethylhexanoate, neodymium (III) hexafluoroacetylacetonate dihydrate, neodymium isopropoxide, neodymium(III) phosphate n-hydrate, neodymium trifluoroacetylacetonate, and neodymium trifluoromethanesulfonate or the like.

However, as a configuration for concentrating Dy or Tb on the grain boundaries of the Nd crystal grains 10, there may be employed a configuration in which agglomerates composed of Dy or Tb are scattered onto the grain boundaries of the Nd crystal grains 10. The similar effect can be obtained even in such a configuration. The concentration of Dy or Tb in the grain boundaries of the Nd crystal grains 10 can be confirmed, for instance, through SEM, TEM or three-dimensional atom probe technique.

[First Method for Manufacturing Permanent Magnet]

Figure 5:
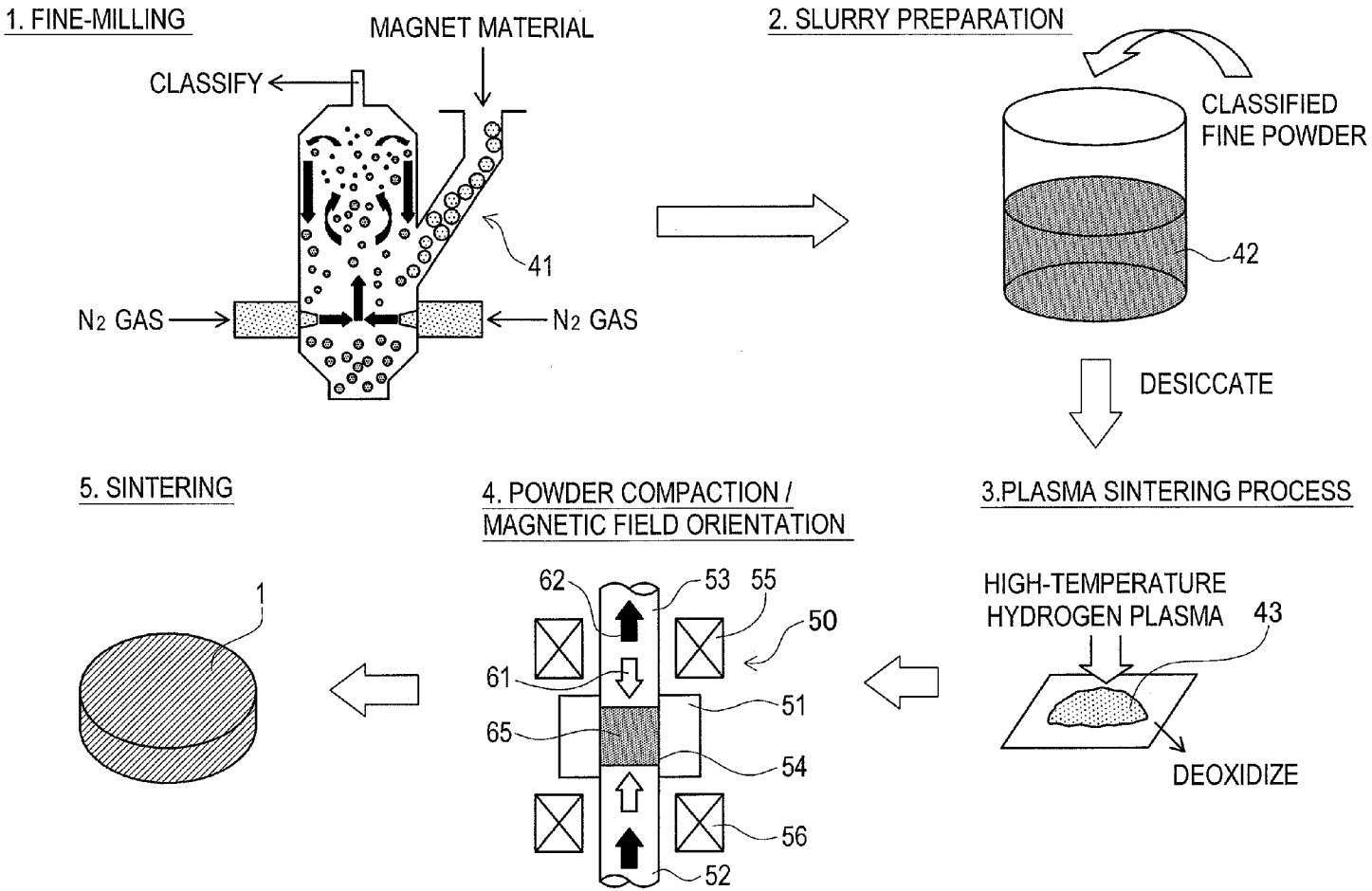
FIG. 5 is an explanatory diagram illustrating manufacturing processes of a permanent magnet according to a first manufacturing method of the invention.

Next, the first method for manufacturing the permanent magnet 1 directed to the present invention will be described below with reference to FIG. 5. FIG. 5 is an explanatory view illustrating a manufacturing process in the first method for manufacturing the permanent magnet 1 directed to the present invention.

First, there is manufactured an ingot comprising Nd—Fe—B of certain fractions for instance, Nd: 32.7 wt %, Fe (electrolytic iron): 65.96 wt %, and B: 1.34 wt %). Thereafter the ingot is coarsely milled using a stamp mill, a crusher, etc. to a size of approximately 200 μm. Otherwise, the ingot is dissolved, formed into flakes using a strip-casting method, and then coarsely powdered using a hydrogen pulverization method.

Next, the coarsely milled magnet powder is finely milled with a jet mill 41 to form fine powder of which the average particle diameter is smaller than a predetermined size (for instance, 0.1 μm through 5.0 μm) in: (a) an atmosphere composed of inert gas such as nitrogen gas, argon (Ar) gas, helium (He) gas or the like having an oxygen content of substantially 0%; or (b) an atmosphere composed of inert gas such as nitrogen gas, Ar gas, He gas or the like having an oxygen content of 0.0001 through 0.5%. Here, the term "having an oxygen content of substantially 0%" is not limited to a case where the oxygen content is completely 0%, but may include a case where oxygen is contained in such an amount as to allow a slight formation of an oxide film on the surface of the fine powder.

In the meantime, organometallic compound solution is prepared for adding to the fine powder finely milled by the jet mill 41. Here, an organometallic compound containing Dy (or Tb) is added in advance to the organometallic compound solution and dissolved therein. Incidentally, in the present invention, it is preferable to use, as the organometallic compound to be dissolved, an organometallic compound (such as dysprosium ethoxide, dysprosium n-propoxide or terbium ethoxide) pertinent to formula $M\text{-}(OR)_x$ (in the formula, M represents Dy or Tb, R represents a straight-chain or branched-chain alkyl group of which carbon number is 2 through 6 and $_x$ represents an arbitrary integer). Furthermore, the amount of the organometallic compound containing Dy (or Tb) to be dissolved is not particularly limited, however, it is preferably adjusted to such an amount that the Dy (or Tb) content with respect to the sintered magnet is 0.001 wt % through 10 wt %, or more preferably, 0.01 wt % through 5 wt %, as above described.

Successively, the above organometallic compound solution is added to the fine powder classified with the jet mill 41. Through this, a slurry 42 in which the fine powder of magnet raw material and the organometallic compound solution are mixed is prepared. Here, the addition of the organometallic compound solution is performed in an atmosphere composed of inert gas such as nitrogen gas, Ar gas or He gas.

Thereafter, the prepared slurry 42 is desiccated in advance through vacuum desiccation or the like before compaction and desiccated magnet powder 43 is obtained. Thereafter, the desiccated magnet powder 43 undergoes a calcination process by plasma heating with high temperature hydrogen plasma. Specifically, the calcination process is performed by putting the magnet powder 43 into a plasma heating apparatus that utilizes "2.45 GHz high-frequency microwaves". To be more specific, in the apparatus, application of voltage to the mixed gas of hydrogen gas and inert gas (for example, Ar gas) causes plasma excitation so as to irradiate the thus generated high temperature hydrogen plasma on the magnet powder for calcination. Incidentally, the flow rate for the supplied gas is within a range of 1 L/min-10 L/min for hydrogen flow and 1 L/min-5 L/min for Argon flow. The output voltage at plasma excitation is within a range of 1 kW-10 kW, and the plasma-irradiation period is within a range of 1-60 seconds. In the above calcination process by the plasma heating, it becomes possible to reduce metal oxides which are present in a state bound with oxygen (such as $Dy_2O$, DyO and $Dy_2O_3$) to metal Dy or metal Tb, or to perform reduction of DyO and the like to oxides with smaller oxidation number (namely, to lower the oxidation number), thereby decreasing in advance the oxygen contained in the magnet powder. As a result, Dy oxide or Tb oxide contained in the magnet powder is reduced before sintering, and the oxygen contained in the magnet powder can be decreased in advance. As a result, in the later sintering process, there does not occur the binding of Nd and oxygen or the formation of Nd oxides, and also alpha iron can be prevented from separating out. Furthermore, specifically in the calcination utilizing the high temperature hydrogen plasma heating, hydrogen radicals can be generated. Using the hydrogen radicals, it becomes possible to perform the reduction to metal Dy and the like or to easily lower the oxidation number in low temperature. Compared with a case of using low temperature hydrogen plasma, the concentration of hydrogen radicals can be made higher in a case of using high temperature hydrogen plasma. Accordingly, stable metal oxides (such as $Dy_2O_3$ and the like) having low free energy of formation can be appropriately reduced.

Figure 6:
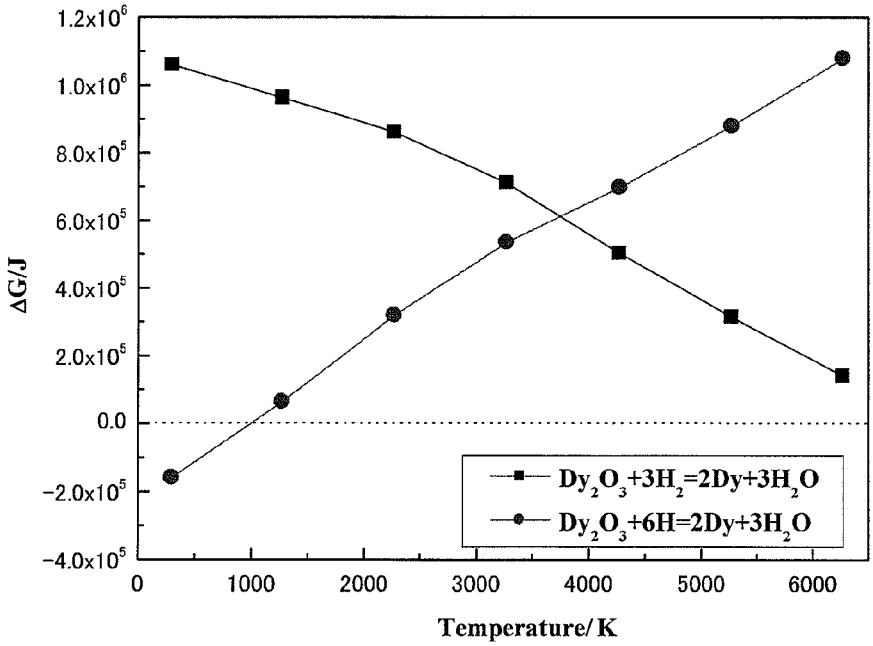
FIG. 6 is an explanatory diagram accounting for superiority of calcination process by high temperature hydrogen plasma heating.

Hereinafter, the superiority of the calcination process using plasma heating is discussed in more detail referring to FIG. 6.

For reducing the stable metal oxides with low free energy of formation (such as $Dy_2O_3$) to metal, it generally requires strong reduction means such as (1) calcium reduction, (2) fused salt electrolysis, (3) laser reduction and the like. However, with such a strong reduction method, the object to be reduced is heated to very high temperature. Therefore, if such a method is performed to Nd magnet particles like those in the present invention, there is a risk that the Nd magnet particles may be fused.

Here, as has been discussed above, the calcination by the above high temperature hydrogen plasma heating makes it is possible to form hydrogen radicals in high concentration. Further, as illustrated in FIG. 6, the lower the temperature is, the stronger reducing character is shown in the reduction by hydrogen radicals. Accordingly, even the stable metal oxide with low free energy of formation such as $Dy_2O_3$ can be reduced in lower temperature than that in the above-mentioned reduction methods (1)-(3). Incidentally, practicability of low temperature reduction may be indicated by the fact that the sintered Nd magnet particles are not fused.

Furthermore, in addition to the above calcination process by the above plasma and the like, another calcination process (calcination process in hydrogen) may be held for several hours (five hours, for instance) in hydrogen atmosphere at 200 through 900 degrees Celsius, more preferably, 400 through 900 degrees Celsius. The timing to perform the calcination process in hydrogen may be either before or after the calcination process by the above plasma heating. Furthermore, the calcination process may be performed to magnet powder either before or after the compaction. During the calcination process in hydrogen, so-called decarbonization is performed in such a manner that carbon content in the calcined body is lowered by causing thermal decomposition to the organometallic compound. Furthermore, the calcination process in hydrogen is to be performed under a condition of less than 0.2 wt % carbon content in the calcined body, or more preferably less than 0.1 wt %. Accordingly, the permanent magnet 1 as a whole can be densely sintered in the following sintering process, and the decrease in the residual magnetic flux density and coercive force can be prevented. Furthermore, in a case where the calcination process in hydrogen is performed, a decarbonization process may be performed after the calcination process in order to lower the activity level of the calcined body activated through the calcination process in hydrogen. More specifically, the decarbonization process may be performed by holding the calcined body for 1-3 hours in vacuum atmosphere at 200 through 600 degrees Celsius, more preferably, 400 through 600 degrees Celsius. However, in a case where the sintering is performed without any exposure to the external air after calcination in hydrogen, the dehydrogenation process becomes unnecessary.

Next, the powdered calcined body 65 calcined at the calcination process by the plasma heating is powder-compacted into a predetermined shape by the compaction device 50.

As illustrated in FIG. 5, the compaction device 50 has a cylindrical mold 51, a lower punch 52 and an upper punch 53, and a space surrounded therewith forms a cavity 54.

In the compaction device 50, a pair of magnetic field generating coils 55 and 56 are disposed in the upper and lower positions of the cavity 54 so as to apply magnetic flux to the calcined body 65 filling the cavity 54. The magnetic field to be applied may be, for instance, 10 kOe.

When performing the powder compaction, firstly, the cavity 54 is filled with the calcined body 65. Thereafter, the lower punch 52 and the upper punch 53 are activated to apply pressure against the calcined body 65 filling the cavity 54 in a pressurizing direction of arrow 61, thereby performing compaction thereof. Furthermore, simultaneously with the pressurization, pulsed magnetic field is applied to the calcined body 65 filling the cavity 54, using the magnetic field generating coils 55 and 56, in a direction of arrow 62 which is parallel with the pressuring direction. As a result, the magnetic field is oriented in a desired direction. Incidentally, it is necessary to determine the direction in which the magnetic field is oriented while taking into consideration the magnetic field orientation required for the permanent magnet 1 formed from the calcined body 65.

After that, there is performed a sintering process for sintering the compacted-state calcined body 65. However, as a sintering method for a compact body, there can be employed, besides commonly-used vacuum sintering, pressure sintering in which the compact body is sintered in a pressured state. For instance, when the sintering is performed in the vacuum sintering, the temperature is risen to approximately 800 through 1080 degrees Celsius in a given rate of temperature increase and held for approximately two hours. During this period, the vacuum sintering is performed, and the degree of vacuum is preferably equal to or smaller than $10^{-4}$ Torr. The compact body is then cooled down, and again undergoes a heat treatment in 600 through 1000 degrees Celsius for two hours. As a result of the sintering, the permanent magnet 1 is manufactured.

Meanwhile, the pressure sintering includes, for instance, hot pressing, hot isostatic pressing (HIP), spark plasma sintering (SPS) and the like. However, it is preferable to adopt the spark plasma sintering which is uniaxial pressure sintering in which pressure is uniaxially applied and also in which sintering is performed by electric current sintering, so as to prevent grain growth of the magnet particles during the sintering and also to prevent warpage formed in the sintered magnets. Incidentally, the followings are the preferable conditions when the sintering is performed in the SPS; pressure is applied at 30 MPa, the temperature is risen in a rate of 10 degrees Celsius per minute until reaching 940 degrees Celsius in vacuum atmosphere of several Pa or lower and then the state of 940 degrees Celsius in vacuum atmosphere is held for approximately five minutes. The compact body is then cooled down, and again undergoes a heat treatment in 600 through 1000 degrees Celsius for two hours. As a result of the sintering, the permanent magnet 1 is manufactured.

[Second Method for Manufacturing Permanent Magnet]

Figure 7:
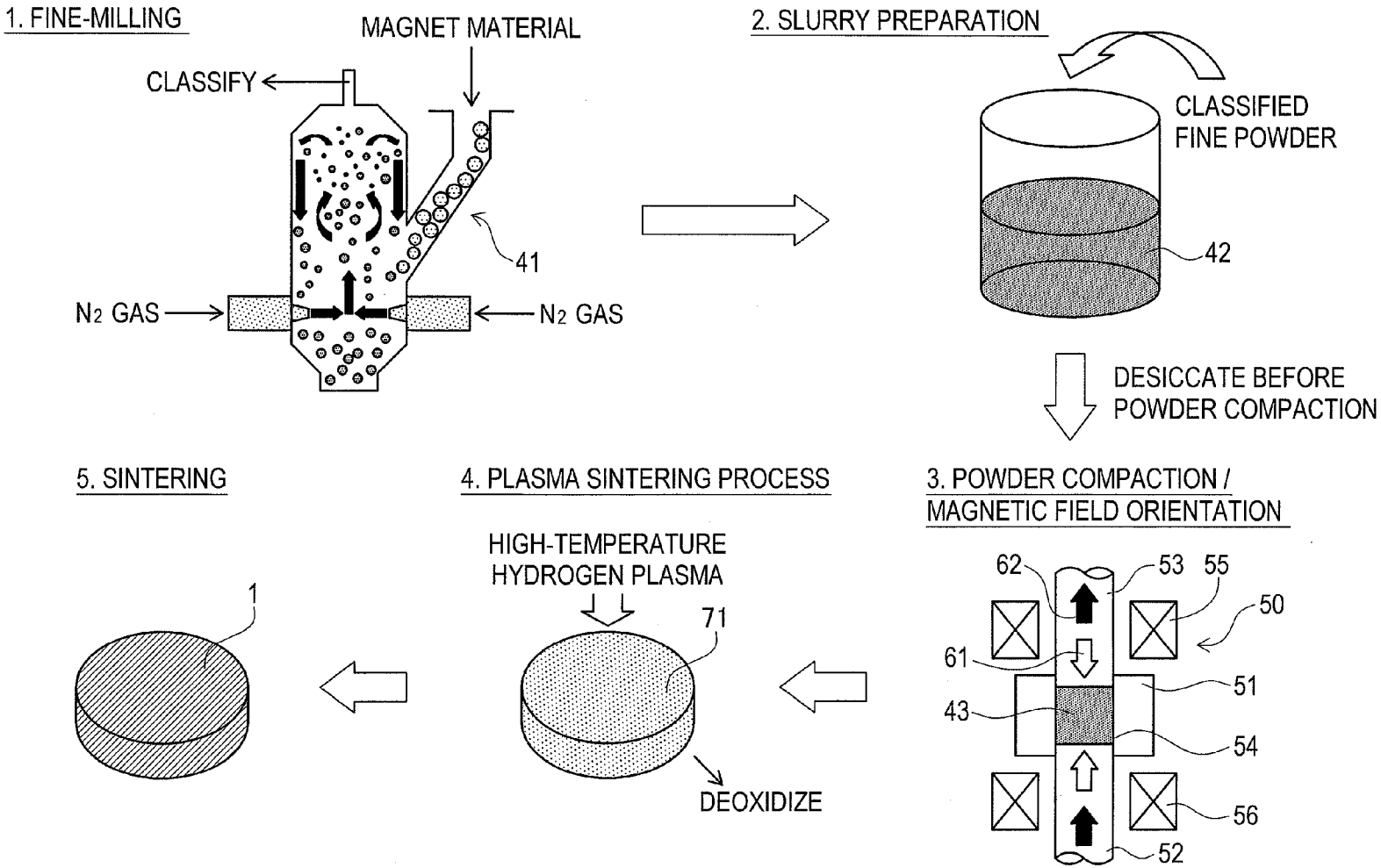
FIG. 7 is an explanatory diagram illustrating manufacturing processes of a permanent magnet according to a second manufacturing method of the invention.

Next, the second method for the manufacturing the permanent magnet 1 which is an alternative manufacturing method will be described below with reference to FIG. 7. FIG. 7 is an explanatory view illustrating a manufacturing process in the second method for manufacturing the permanent magnet 1 directed to the present invention.

The process until the slurry 42 is manufactured is the same as the manufacturing process in the first manufacturing method already discussed referring to FIG. 5, therefore detailed explanation thereof is omitted.

First, the prepared slurry 42 is desiccated in advance through vacuum desiccation or the like before compaction and desiccated magnet powder 43 is obtained. Then, the desiccated magnet powder is subjected to powder-compaction to form a given shape using a compaction device 50. There are dry and wet methods for the powder compaction, and the dry method includes filling a cavity with the desiccated fine powder and the wet method includes preparing slurry of the desiccated fine powder using solvent and then filling a cavity therewith. In this embodiment, a case where the dry method is used is described as an example. Furthermore, the organometallic compound solution can be volatilized at the sintering stage after compaction. Incidentally, details of the compaction device 50 are omitted because manufacturing processes performed here in the second method are the same as those of the first method already described by referring to FIG. 5. Furthermore, in a case where the wet method is used, slurry may be injected while applying the magnetic field to the cavity 54, and in the course of the injection or after termination of the injection, a magnetic field stronger than the initial magnetic field may be applied to perform the wet molding. Furthermore, the magnetic field generating coils 55 and 56 may be disposed so that the application direction of the magnetic field is perpendicular to the pressuring direction.

Thereafter, the compact body 71 obtained through powder-compaction undergoes a calcination process by plasma heating with high temperature hydrogen plasma. Specifically, the calcination process is performed by putting the compact body 71 into a plasma heating apparatus. To be more specific, in the apparatus, application of voltage to the mixed gas of hydrogen gas and inert gas (for example, Ar gas) causes plasma excitation so as to irradiate the thus generated high temperature hydrogen plasma on the compact body 71 for calcination. Incidentally, the flow rate for the supplied gas is within a range of 1 L/min-10 L/min for hydrogen flow and 1 L/min-5 L/min for Argon flow. The output voltage at plasma excitation is within a range of 1 kW-10 kW, and the plasma-irradiation period is within a range of 1-60 seconds.

Then, there is performed a sintering process for sintering the compact body 71 calcined through plasma heating. The sintering process is performed by the vacuum sintering or the pressure sintering similar to the above first manufacturing method. Details of the sintering condition are omitted because the manufacturing process here is similar to that of the first manufacturing method already described. As a result of the sintering, the permanent magnet 1 is manufactured.

The first manufacturing method discussed above has an advantage that the calcination process in hydrogen is performed to the powdery magnet particles, reduction of metal oxides can be performed to the whole magnet particles in comparison with the second manufacturing method in which the calcination process is performed to the compacted magnet particles. That is, the first manufacturing method makes it possible to more securely decrease the oxygen content in the calcined body, in comparison with the second manufacturing method.

Embodiment

Here will be described an embodiment according to the present invention referring to a comparative example for comparison.

Embodiment

In comparison with fraction regarding alloy composition of a neodymium magnet according to the stoichiometric composition (Nd: 26.7 wt %, Fe (electrolytic iron): 72.3 wt %, B: 1.0 wt %), proportion of Nd in that of the neodymium magnet powder for the embodiment 1 is set higher, such as Nd/Fe/B=32.7/65.96/1.34 in wt %, for instance. Further, 5 wt % of dysprosium n-propoxide has been added as organometallic compound containing Dy (or Tb) to milled neodymium magnet powder. A calcination process with plasma heating has been performed by using high temperature hydrogen plasma. Regarding flow rate of gases to be supplied during the calcination process, both hydrogen feed rate and Argon feed rate are set to 3 L/min. The output voltage at plasma excitation is set to 3 kW, and the plasma-irradiation is performed for 60 seconds. Sintering of the compacted-state calcined body has been performed in the SPS. Other processes are the same as the processes in [First Method for Manufacturing Permanent Magnet] mentioned above.

Comparative Example

Dysprosium n-propoxide has been used as organometallic compound to be added, and sintering has been performed without undergoing a calcination process by plasma heating. Other conditions are the same as the conditions in the embodiment.

(Comparative Analysis on Embodiment and Comparative Example in View of Application/Non-application of Calcination Process by Plasma Heating)

Figure 8:
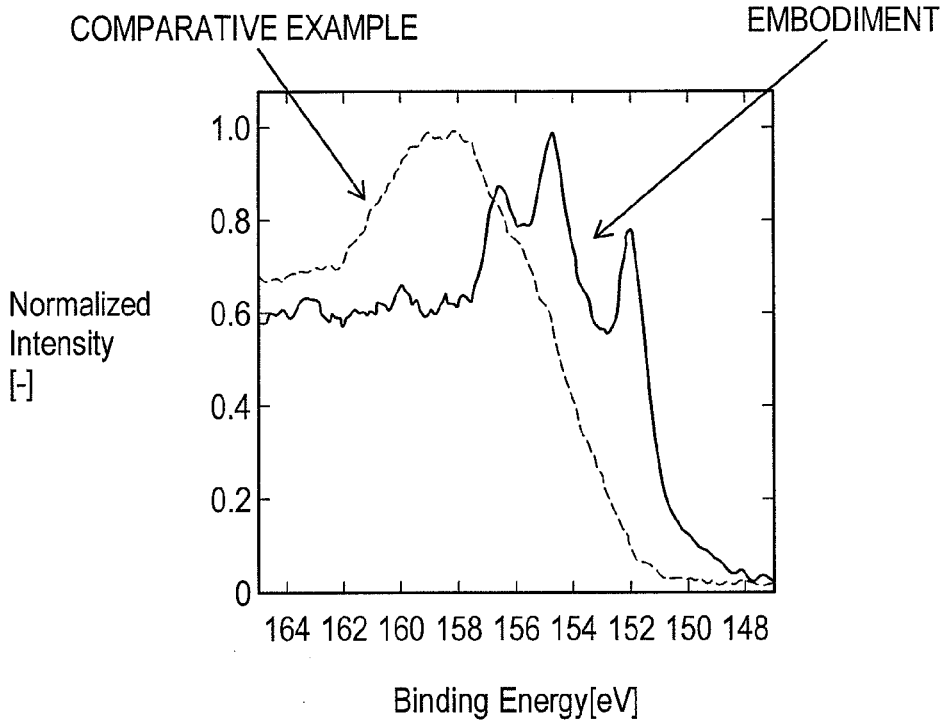
FIG. 8 is a chart depicting spectra detected in a range of 147 eV-165 eV binding energy, with respect to a permanent magnet of an embodiment and a permanent magnet of a comparative example.

Permanent magnets according to the embodiment and the comparative example are analyzed using an X-ray photoelectron spectrometer (or electron spectrometer for chemical analysis, ESCA). FIG. 8 is a chart depicting spectra detected in a range of 147 eV-165 eV binding energy, with respect to the permanent magnets of the embodiment and the comparative example. FIG. 9 is a chart depicting a result of waveform analysis of the spectra of FIG. 8.

AS illustrated in FIG. 8, the permanent magnets of the embodiment and the comparative example have different spectral shapes with each other. Here, the mixture proportion with respect to each spectrum is calculated based on the standard sample, and the proportions of Dy, $Dy_2O$, DyO and $Dy_2O_3$ are depicted respectively in FIG. 9. As shown in FIG. 9, Dy comprises 75% and Dy oxides ($Dy_2O$, DyO and $Dy_2O_3$) comprise 25% in the permanent magnet of the embodiment, whereas Dy comprises nearly 0% and Dy oxides ($Dy_2O$, DyO and $Dy_2O_3$) comprise nearly 100% in the permanent magnet of the comparative example.

That is, with respect to the permanent magnet according to the embodiment after the calcination process by plasma heating, most part of Dy oxides ($Dy_2O$, DyO and $Dy_2O_3$) which have been present in the state bound with oxygen is successfully reduced to metal Dy. Even if the reduction of Dy oxides may not reach the metal Dy state, the Dy oxides can still be reduced to oxides with smaller oxidation number (in other words, the oxidation number can be lowered), so that the oxygen contained in the magnet powder can be decreased in advance. Thus, in the permanent magnet of the embodiment, the Dy oxide or Tb oxide contained in the magnet powder can be reduced before sintering, so that the oxygen contained in the magnet powder can be reduced in advance. Thereby, the binding of Nd and oxygen and the formation of a Nd oxide in the later sintering process can be prevented. Accordingly, in the permanent magnet of the embodiment, deterioration of the magnet properties due to presence of the metal oxides can be prevented and alpha iron can be prevented from separating out. That is, a permanent magnet with high quality can be obtained.

Meanwhile, the permanent magnet of the comparative example has a large proportion of remnant Dy oxides, therefore Nd is likely to bind with oxygen in the sintering process, and Nd oxides are formed. Further, alpha iron separates out in large amount. As a result, deterioration of the magnetic properties occurs in the comparative example.

As described in the above, with respect to the permanent magnet 1 and the manufacturing method of the permanent magnet 1 directed to the above embodiment, an organometallic compound solution is added to fine powder of pulverized neodymium magnet so as to uniformly adhere the organometallic compound to particle surfaces of the neodymium magnet powder, the organometallic compound being expressed with a structural formula of $M\text{-}(OR)_X$ (M represents Dy or Tb, R represents a substituent group consisting of straight-chain or branched hydrocarbons and $_X$ represents an arbitrary integer). Thereafter, a calcination process is performed to magnet powder by means or plasma heating. After compaction of the magnet powder, vacuum sintering and pressure sintering are performed to the compacted magnet powder and the permanent magnet 1 is thus manufactured. Owing to the above processes, even though amount of to-be-added Dy or Tb is made less in comparison with conventional one, Dy or Tb added thereto can be efficiently concentrated in a grain boundary of the magnet. Consequently, usage of Dy or Tb is reduced so that decline in residual magnetic flux density can be avoided and improvement of coercive force can be realized. Further, decarbonization is made easier when adding the above specified organometallic compound to magnet powder in comparison with when adding other organometallic compounds. Furthermore, such sufficient decarbonization can avoid decline in coercive force which is likely to be caused by carbon contained in the sintered magnet. Furthermore, owing to such sufficient decarbonization, the entirety of the magnet can be sintered densely.

Still further, Dy or Tb having high magnetic anisotropy is concentrated in a grain boundary of the sintered magnet. Therefore, coercive force can be improved by preventing Dy or Tb, concentrated in the grain boundary, from generating a reverse magnetic domain in the grain boundary. Further, since amount of Dy or Tb added thereto is less in comparison with conventional amount thereof, decline in residual magnetic flux density can be avoided.

Furthermore, Dy or Tb concentrated in the grain boundaries of a magnet forms a layer of 1 nm-500 nm, preferably 2 nm-200 nm in thickness on the surface of each magnet particle after sintering. Accordingly, while enabling improvement of the coercive force by Dy or Tb, the $Nd_2Fe_{14}B$ intermetallic compound phase of the core constitutes a significant fraction of the whole crystal grains (in other words, the whole sintered magnet). Accordingly, there can be prevented the decrease of the residual magnetic flux density (magnetic flux density when the external magnetic field is made to be 0) in the permanent magnet.

The organometallic-compound-added magnet powder or the compact body is calcined by utilizing plasma heating prior to sintering. Thereby, such mannered manufacturing process makes it possible to reduce Dy or Tb present therein in a state bound with oxygen to metal Dy or metal Tb, or to an oxide with smaller oxidation number such as DyO, etc. (that is, to lower the oxidation number) before sintering. Thus, even if the organometallic compound is added, there can be prevented the increase of the oxygen content contained in the magnet particles. Since such mannered manufacturing process prevents alpha iron from separating out in a main phase of the sintered magnet and also prevents formation of oxides, serious degrade in the magnetic properties can be avoided.

Furthermore, as the calcination process by plasma heating is performed under 1 kW-10 kW output voltage, with 1 L/min-10 L/min hydrogen flow and 1 L/min-5 L/min Argon flow and for an irradiation time period of 1-60 seconds, the magnet powder or compact body can be calcined under an appropriate condition using plasma heating, so that the oxygen content contained in the magnet particle can be more reliably decreased. Moreover, as the high temperature hydrogen plasma heating is applied as specific means for calcination, high concentration of hydrogen radicals can be generated. Accordingly, even if the metal forming an organometallic compound is present in the magnet powder in a state of a stable oxide, the reduction to a metal or lowering of the oxidation number thereof can be easily performed at a low temperature using the hydrogen radicals.

Furthermore, specifically in the first manufacturing method, the calcination process is performed to the powdered magnet particles, which is advantageous in that the reduction of metal oxides can be performed more easily to the whole magnet particles, compared with the case where the magnet particles are calcined after compaction. That is, compared with the second manufacturing method, the oxygen content in the calcined body can be more reliably decreased.

Furthermore, if the organometallic compound to be added is specifically chosen from the organometallic compound composed of alkyl group, or more preferably an organometallic compound composed of alkyl group of carbon number 2-6, thermal decomposition of the organometallic compound can be caused at a low temperature when the magnet powder or the compact body is calcined in hydrogen atmosphere. Thereby, thermal decomposition of the organometallic compound can easily be caused to the whole magnet powder or the whole compact body. Accordingly, such mannered manufacturing process can prevent alpha iron from separating out within the main phase of the magnet after sintering. Thereby, the whole magnet can be densely sintered and the lowering of the coercive force can be prevented.

Not to mention, the present invention is not limited to the above-described embodiment but may be variously improved and modified without departing from the scope of the present invention.

Further, of magnet powder, milling condition, mixing condition, calcination condition, dehydrogenation condition, sintering condition, etc. are not restricted to conditions described in the embodiment.

Further, in the embodiment, dysprosium n-propoxide is used as Dy-or-Tb-inclusive organometallic compound that is to be added to magnet powder. Other organometallic compounds may be used as long as being an organometallic compound that satisfies an expression of $M\text{-}(OR)_X$ (M represents Dy or Tb, R represents a substituent group consisting of a straight-chain or branched-chain hydrocarbon, and $_X$ represents an arbitrary integer). For instance, there may be used an organometallic compound of which carbon number is 7 or larger and an organometallic compound including a substituent group consisting of carbon hydride other than an alkyl group.

EXPLANATION OF REFERENCES

1 permanent magnet
11 Nd crystal grain
12 Dy layer (Tb layer)
42 slurry
43 magnet powder
65 calcined body
71 compact body

The invention claimed is:

1. A manufacturing method of a Nd—Fe—B based permanent magnet comprising steps of:

milling magnet material into magnet powder;

adding an organometallic compound expressed with a structural formula of $$M\text{-}(OR)_X$$

M representing Dy or Tb, R representing a substituent group consisting of a straight-chain or branched-chain hydrocarbon, and $_X$ representing an arbitrary integer, to the magnet powder obtained at the step of milling magnet material and getting the organometallic compound adhered to particle surfaces of the magnet powder;

calcining the magnet powder of which particle surfaces have got adhesion of the organometallic compound by plasma heating so as to obtain a calcined body;

compacting the calcined body so as to obtain a compact body; and sintering the compact body, wherein the permanent magnet is Nd—Fe—B based.

2. A manufacturing method of a Nd—Fe—B based permanent magnet comprising steps of:

milling magnet material into magnet powder;

adding an organometallic compound expressed with a structural formula of $$M\text{-}(OR)_X$$

M representing Dy or Tb, R representing a substituent group consisting of a straight-chain or branched-chain hydrocarbon, and $_X$ representing an arbitrary integer, to the magnet powder obtained at the step of milling magnet material and getting the organometallic compound adhered to particle surfaces of the magnet powder;

compacting the magnet powder of which particle surfaces have got adhesion of the organometallic compound so as to obtain a compact body;

calcining the compact body by plasma heating so as to obtain a calcined body; and sintering the calcined body, wherein the permanent magnet is Nd—Fe—B based.

3. The manufacturing method of a Nd—Fe—B based permanent magnet according to claim 1, wherein the calcined body is obtained at the step of calcining by high temperature hydrogen plasma heating.

4. The manufacturing method of a Nd—Fe—B based permanent magnet according to according to claim 1, wherein R in the structural formula is an alkyl group.

5. The manufacturing method of a Nd—Fe—B based permanent magnet according to claim 4, wherein R in the structural formula is an alkyl group of which carbon number is any one of integer numbers 2 through 6.

6. The manufacturing method of a Nd—Fe—B based permanent magnet according to claim 2, wherein the calcined body is obtained at the step of calcining by high temperature hydrogen plasma heating.

7. The manufacturing method of a Nd—Fe—B based permanent magnet according to claim 2, wherein R in the structural formula is an alkyl group.

8. The manufacturing method of a Nd—Fe—B based permanent magnet according to claim 7, wherein R in the structural formula is an alkyl group of which carbon number is any one of integer numbers 2 through 6.

* * * * *